US005145319A

United States Patent [19]

Glowacki

[11] Patent Number: 5,145,319

[45] Date of Patent: Sep. 8, 1992

[54] AXIAL FLOW TURBOMACHINE ROTOR

[75] Inventor: Pierre A. Glowacki, Fontaine le Port, France

[73] Assignee: Societe Nationale D'Etude et de Construction de Moteurs d'Aviations S.N.E.M.C.A., Paris, France

[21] Appl. No.: 616,594

[22] Filed: Nov. 21, 1990

[30] Foreign Application Priority Data

Nov. 22, 1989 [FR] France ..... 89 15301

[51] Int. Cl.[5] ..... F01D 5/22; F01D 5/30

[52] U.S. Cl. ..... 416/193 A; 416/217; 416/230

[58] Field of Search ..... 416/193 A, 204 A, 212 A, 416/214 A, 215, 217, 219 R, 220 R, 230

[56] References Cited

U.S. PATENT DOCUMENTS

| | | | |
|---|---|---|---|
| 2,326,145 | 8/1943 | Kroon . | |
| 2,514,408 | 7/1950 | Mierley . | |
| 2,928,653 | 3/1960 | Robertson . | |
| 2,999,668 | 9/1961 | Howald et al. | 416/217 |
| 3,694,104 | 9/1972 | Erwin . | |
| 3,860,361 | 11/1975 | McMurtry et al. | 416/212 A |
| 4,361,416 | 11/1982 | Rossmann . | |
| 4,460,316 | 7/1984 | Partington . | |
| 4,621,979 | 11/1986 | Zipps et al. | 416/193 A |
| 4,696,623 | 9/1987 | Bost | 416/230 |

FOREIGN PATENT DOCUMENTS

| | | | |
|---|---|---|---|
| 958441 | 3/1950 | France . | |
| 989556 | 9/1951 | France | 416/193 A |
| 1234275 | 10/1960 | France . | |
| 1457941 | 11/1966 | France . | |
| 2283308 | 3/1976 | France . | |
| 242977 | 1/1926 | United Kingdom . | |
| 619913 | 3/1949 | United Kingdom | 416/215 |
| 1331209 | 9/1973 | United Kingdom . | |

*Primary Examiner*—Edward K. Look
*Assistant Examiner*—James A. Larson
*Attorney, Agent, or Firm*—Oblon, Spivak, McClelland, Maier & Neustadt

[57] ABSTRACT

An axial flow turbomachine rotor comprises a disc having a plurality of annular flanges extending outwardly from its periphery, a plurality of blades secured to the disc and extending radially outwardly from the periphery thereof, each of the blades having its root notched to define heels which are received in the grooves formed between the annular flanges of the disc, and a plurality of separate platforms which are secured to the disc and are disposed between the blades to define the inner boundary of the fluid flow path through the rotor, the blades each being fixed to the disc by two parallel pins which are equidistance from the axis of the disc and are received in corresponding bores passing through the annular flanges and the heels of the blade, the pins also serving to secure the platforms to the disc.

9 Claims, 3 Drawing Sheets

AXIAL FLOW TURBOMACHINE ROTOR

BACKGROUND OF THE INVENTION

1. Field of the Invention

The present invention relates to an axial flow turbomachine rotor of the type comprising a disc having a plurality of flanges extending radially outwards from its periphery in such a manner as to define a plurality of annular grooves between said flanges, a plurality of blades secured to the disc so that they are evenly arranged around the periphery of the disc and extend radially outwards therefrom, each blade having a notched root defining heels which are received in respective ones of the annular grooves of the disc, and a plurality of separate platforms fixed to the disc so that each is disposed between two adjacent blades to define the disc side of the fluid flow path between the blades when the rotor is operating.

2. Summary of the Prior Art

Axial flow turbomachine rotors using blades without integral platforms are known, the blades each having a root which has a comb type attachment which is fixed by an axial pin to the annular flanges of the disc. This type of blade attachment simplifies the manufacture of the disc compared to a disc having non-notched blades requiring axial sockets on the periphery of the disc. The problem posed, however, especially for the large chord blades used in fans and compressors, is the accommodation of stresses in all directions and, in Particular, the accommodation of the tangential components of the forces applied to the blades.

U.S. Pat. No. 3,694,104 describes a blade of composite material in which the root is notched and has heels each having a hole defined by a metal bush or sleeve intended to cooperate with a pin. The root of the blade is fixed to the flanges of the disc by means of two axially offset pins, one being situated on the upstream side of the blade in the leading edge plane, and the other on the downstream side in the trailing edge plane This arrangement does not enable the pins to accommodate the whole of the forces applied to the blades. Thus, the separate platforms interposed between the blades are biased for the accommodation of the tangential components of the forces, and they must be rigid and firmly fixed to the disc by fixing screws, which increases the weight of the rotor. Moreover, the angular offset between the axis of the upstream pin and the axis of the downstream pin creates difficulties in the construction of the blade and of the disc. Some pins and fixing screws are mounted from the front face of the disc, and others from the rear face. This necessitates removal of the rotor if it is to be dismantled.

In other types of rotor constructions, the tangential forces are accommodated by the fixing pin of the blade root thanks to curvilinear surfaces at the end of the root which fit perfectly on the cylindrical surfaces of the disc. U.S. Pat. No. 4,361,416 discloses such an arrangement of the blades, which leads inevitably to an increase of the mass of the blade root.

SUMMARY OF THE INVENTION

It is an object of the present invention to overcome these drawbacks, and to provide a turbomachine rotor of the type hereinbefore described in which the means for fixing each blade on the disc make it possible to accommodate the whole of the forces exerted on the blades.

Accordingly, there is provided an axial flow turbomachine rotor comprising a disc having an axis, a circumferentially extending periphery, and a plurality of annular flanges extending outwards from said periphery to define a plurality of annular grooves between said flanges, said flanges including front and rear annular flanges respectively positioned upstream and downstream with respect to the direction of fluid flow through said rotor; a plurality of blades mounted on the periphery of said disc, said blades being arranged evenly around said periphery and extending radially outwards therefrom, each of said blades having a root at its radially inner end, said root being notched so as to define heels which are received by respective ones of said annular grooves; fixing means securing said blades to said disc; and a Plurality of separate Platforms fixed to said disc so that each platform is disposed between two adjacent blades to delimit the disc side of the fluid flow path through said rotor; wherein said fixing means comprises, for each of said blades, a pair of substantially parallel pins equidistant from the periphery of said disc, and corresponding bores passing right through said annular flanges of said disc and said heels of the blade, said pins extending through said bores at least between said front and rear annular flanges, and each of said Pins having a head at one end of said pin; and wherein each of said platforms has front and rear end plates projecting radially inwardly towards said disc axis at the upstream and downstream ends respectively of said platform, and said front and rear end plates of each platform are provided with apertures for the passage of two adjacent pins belonging to said fixing means of the neighboring blades.

As a result of this arrangement, the parallel and circumferentially offset pins ensure accommodation of stresses in all directions. The separate platforms are no longer subject to tangential stresses and they can therefore be lighter. Also, the number of parts used for fixing the blades and the platforms is less with respect to the prior art.

Preferably the bores through the heels of the root of each blade and through the annular flanges are parallel to the axis of the disc. This facilitates drilling of the annular flanges.

In order to lighten the disc, the annular flanges are preferably cut away between the roots of adjacent blades.

Preferably each heel of each blade includes bushes defining the portions of said bores extending through said heel, and each of said blades is made of a composite material including fibers which pass around said bushes in said heels of said blade and extend therefrom towards the outer end of said blade.

Other advantages and features of the invention will become apparent from the following description of a preferred embodiment with reference to the attached drawings.

DESCRIPTION OF THE PREFERRED EMBODIMENT

Figure 1:
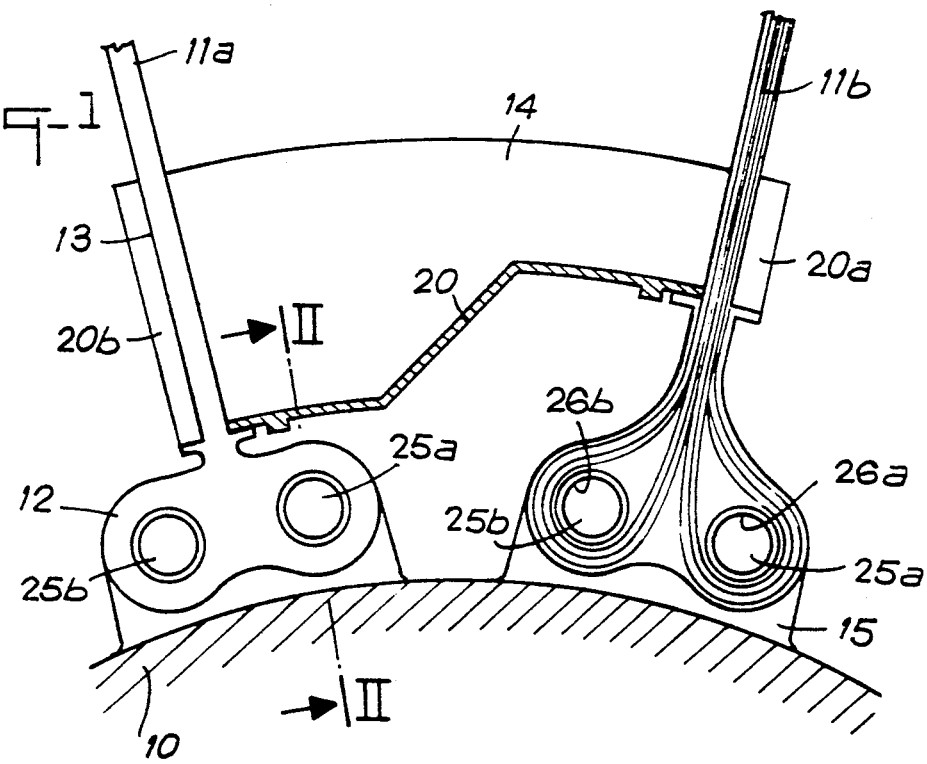
FIG. 1 is a diagrammatic, part sectional front view of part of one embodiment of a rotor in accordance with the invention, showing the arrangement of two adjacent blades and a platform disposed between them on the disc of the rotor.
Figure 2:
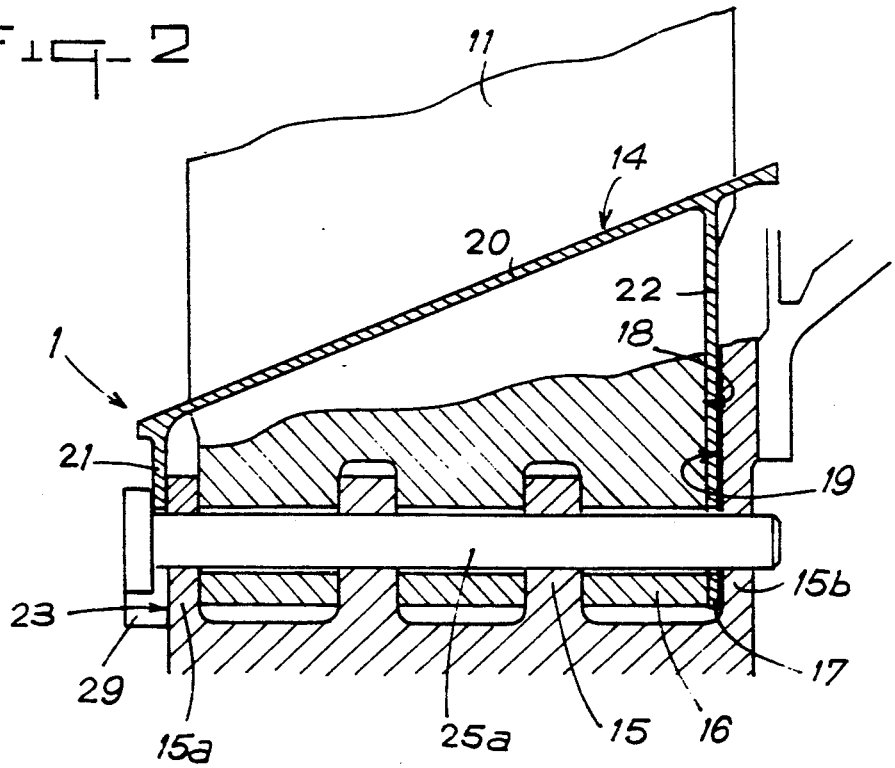
FIG. 2 is an axial section through part of the rotor, taken along line II—II in FIG. 1.
Figure 3:
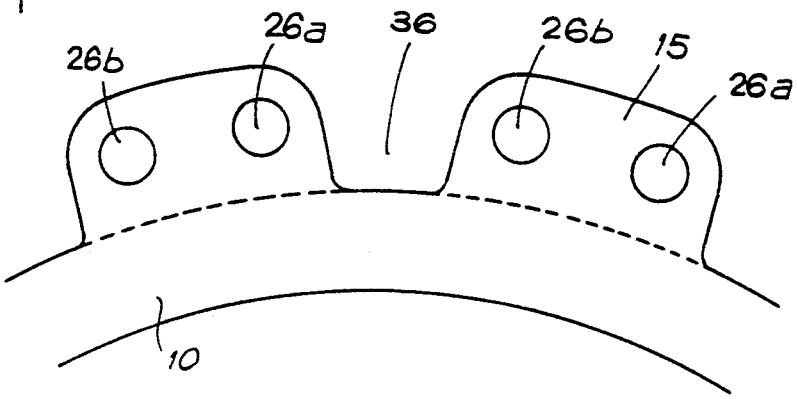
FIG. 3 is a front view of part of the front face of the rotor disc.
Figure 4:
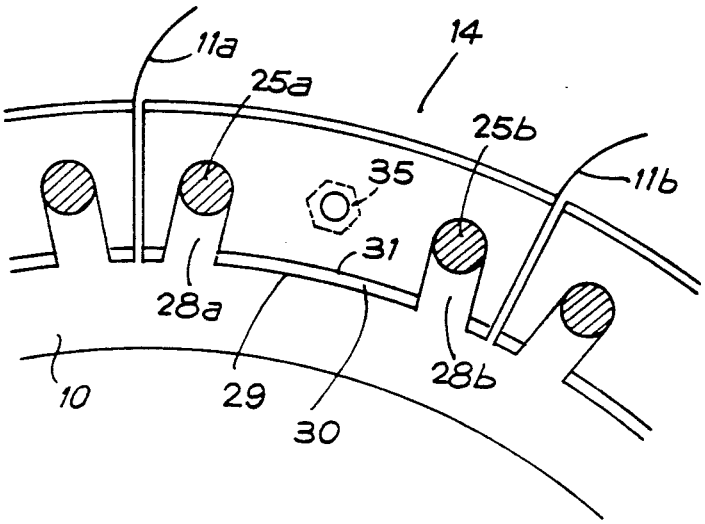
FIG. 4 is a front view of part of the front face of the rotor with the pin heads removed.
Figure 5:
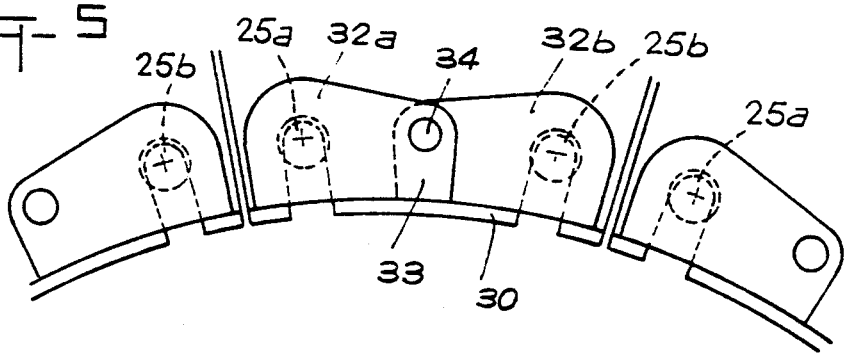
FIG. 5 is a front view of part of the front face of the rotor showing the fixing of the pin heads.
Figure 6:
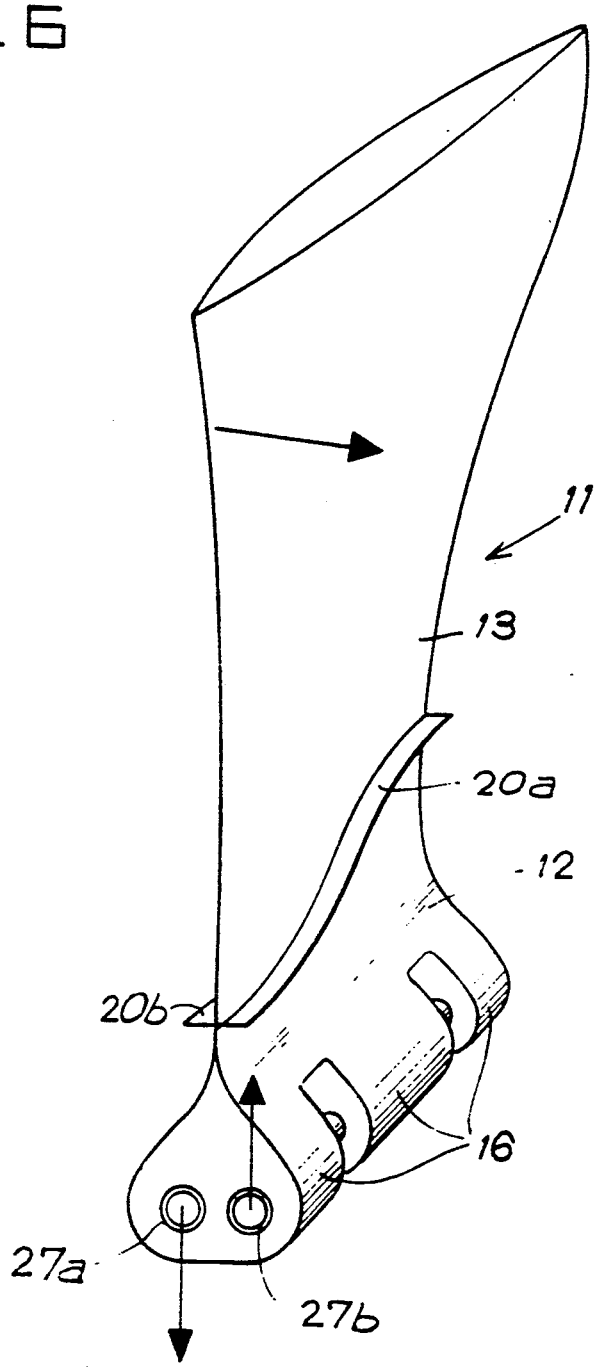
FIG. 6 is a perspective view of a blade of the rotor.

The axial flow turbomachine rotor 1 shown in the drawings comprises a rotor disc 10 in the form of a rim, and a plurality of blades 11 fixed to the disc at evenly spaced intervals around its periphery. Each blade comprises a root 12 for attachment to the periphery of the disc, and a vane 13 which extends radially outwards from the periphery. Separate platforms 14 are mounted between the blades 11 to define the boundary, on the rotor axis side, of the gas flow path (upstream to downstream) through the rotor 1 when the rotor is operating.

For the connection of the blades 11 to the disc 10 the latter comprises a plurality of annular flanges 15 which extend radially outwards from the periphery of the disc. The root 12 of each blade has radial notches corresponding to the annular flanges 15 so that the root is formed with heels 16 which fit in the grooves defined between the annular flanges 15. The number of annular flanges 15 is one more than the number of heels 16, so that the blade roots 12 are disposed between a front flange 15*a* at the upstream side of the rotor and a rear flange 15*b* at the downstream side.

The axial length of each heel 16 is equal to the distance separating adjacent annular flanges so as to prevent axial displacement of the blades 11. However, a gap 17 is provided between the downstream face 18 of the blade root 12 and the upstream face 19 of the rear annular flange 15*b*.

Each platform 14 has a wall 20 which is inclined with respect to the axis of the rotor 1 and which extends laterally between the facing faces of two consecutive blades 11*a* and 11*b*, the longitudinal side edges of the wall 20 resting on supporting wings 20*a* and 20*b* provided on the faces of the blades 11*a* and 11*b*. At its upstream and downstream ends respectively the platform further has front and rear end plates 21 and 22 which extend radially inwards towards the axis of the rotor 1. The front end plate 21 is disposed against the upstream face 23 of the front annular flange 15*a*, and the rear end plate 22 fits into the gap 17 provided between the downstream face 18 of each blade root 12 and the upstream face 19 of the rear annular flange 15*b*, thus preventing axial displacement of the platform 14.

Each blade 11 is fixed to the disc 10 by means of two pins 25*a* and 25*b* which are inserted from the front face of the rotor 1 into two passages 26*a* and 26*b* which are parallel and equidistant from the axis of the rotor 1. The passages 26*a* and 26*b* are defined by aligned bores Provided in the annular flanges 15 and the heels 16 of the blade root 12. The front and rear end plates 21 and 22 of each platform also have apertures for the passage of two adjacent pins 25*a* and 25*b*, one belonging to one of the two adjacent blades 11*a* and 11*b*, and the other belonging to the other of the two blades.

The pins 25*a* and 25*b* securing each blade 11 thus hold the blade 11 on the disc 10 and accommodate the radial and tangential components of the forces which are exerted on the blade 11.

Preferably, each blade 11 is made of a composite material, and each heel 16 of the blade includes two parallel bushes or sleeves 27*a* and 27*b* defining parts of the bores 26*a* and 26*b*. The fibers of the composite material forming the vane 13 of the blade pass around the bushes 27*a* and 27*b* in the heels, extending in a direction from the intrados towards the extrados face of the blade, and provide for continuity of the centrifugal loadings.

The pins 25*a* and 25*b* extend at least between the front and rear annular flanges 15*a* and 15*b*, and they have pin heads 32*a* and 32*b* respectively which act on the upstream faces of the front end plates 21 of the platforms 14.

Preferably, the apertures of the front end plate 21 of each platform 14 through which a pair of pins 25*a* and 25*b* pass are formed by slots 28*a* and 28*b* which are substantially parallel and open at the radially inner edge 29 of the front end plate 21. This edge 29 has a flange or lip 30 extending axially in an upstream direction to provide a radially outer face 31 which is intended to cooperate with the radially inward edges of the pin heads 32*a* and 32*b* lying against the front end plate 31 to lock the platform 14 radially.

The heads 32*a* and 32*b* of each pair of pins 25*a* and 25*b* which secure a platform 14 are of substantially trapezoidal shape, each having a lateral extension portion 33 at the side facing the other pin. The extension portion 33 of each pin head has a cut-out which accommodates the extension portion of the other pin head in such a manner that the said extension portions 33 are superimposed in line with the central area of the front end plate 21 of the platform 14. The two pins 25*a* and 25*b* are fixed together and to the platform 14 by means of a fixing screw 34 passing through aligned holes provided in the superimposed extension portions 33 and the front end plate 21 and cooperating with a nut 35 attached to the downstream face of the front end plate 21.

In order to lighten the disc 10, notches may be cut out of the annular flanges 15 substantially mid-way between the roots of adjacent blades as indicated at 36.

The assembly of the rotor 1 is effected as follows. Firstly, each blade 11 is placed on the disc 10 in such a manner that the bores through the heels of the blade root 12 are aligned with the corresponding bores through the annular flanges 15, and the pins 25*a* and 25*b* are introduced from the front face of the disc 10 partially into the passages 26*a* and 26*b* to immobilize the blade 11. After having thus immobilized all the blades 11, each platform 14 is mounted in position and secured by fully inserting the corresponding pins 25*a* and 25*b* into the passages 26*a* and 26*b* so that the pin heads 32*a*, 32*b* engage with the lip 30 to hold the platform 14 radially. The heads 32*a*, 32*b* of the two pins 25*a* and 25*b* holding each platform 14 are then fixed together and also to the front end plate 21 of the platform by means of the fixing screws 34.

What is claimed is:

1. An axial flow turbomachine rotor comprising:

a disc having an axis, a circumferentially extending periphery, and a plurality of annular flanges extending outward from said periphery to define a plurality of annular grooves between said flanges, said flanges including front and rear annular flanges respectively positioned upstream and downstream with respect to the direction of fluid flow through said rotor;

a plurality of blades mounted on the periphery of said disc, said blades being arranged evenly around said periphery and extending radially outward therefrom, each of said blades having a root at its radially inner end, said root being notched so as to define heels which are received by respective ones of said annular grooves;

fixing means securing said blades to said disc; and a plurality of separate platforms fixed to said disc so that each platform is disposed between two adjacent blades to delimit the disc side of the fluid flow path through said rotor;

wherein said fixing means comprises, for each of said blades:

a pair of substantially parallel pins equidistant from the periphery of said disc said pins being the radially innermost connection of the blades to said disc, and corresponding bores passing right through said annular flanges of said disc and said heels of the blade, said pins extending through said bores at least between said front and rear annular flanges, and each of said pins having a head at one end of said pin;

and wherein each of said platforms has front and rear end plates projecting radially inwardly towards said disc axis at the upstream and downstream ends respectively of said platform, and said front and rear end plates of each platform are provided with apertures for the passage of two adjacent pins belonging to said fixing means of the neighboring blades.

2. A rotor according to claim 1, wherein said bores through said blade heels and said annular flanges are parallel to said disc axis.

3. A rotor according to claim 1, wherein each of said blades has a platform support wing on each face of said blade, and each of said platforms is mounted with its axially extending side edges resting on support wings of the two adjacent blades.

4. An axial flow turbomachine rotor comprising:

a disc having an axis, a circumferentially extending periphery, and a plurality of annular flanges extending outward from said periphery to define a plurality of annular grooves between said flanges, said flanges including front and rear annular flanges respectively positioned upstream and downstream with respect to the direction of fluid flow through said rotor;

a plurality of blades mounted on the periphery of said disc, said blades being arranged evenly around said periphery and extending radially outward therefrom, each of said blades having a root at its radially inner end, said root being notched so as to define heels which are received by respective ones of said annular grooves;

fixing means securing said blades to said disc; and a plurality of separate platforms fixed to said disc so that each platform is disposed between two adjacent blades to delimit the disc side of the fluid flow path through said rotor;

wherein said fixing means comprises, for each of said blades:

a pair of substantially parallel pins equidistant from the periphery of said disc, and corresponding bores passing right through said annular flanges of said disc and said heels of the blade, said pins extending through said bores at least between said front and rear annular flanges, and each of said pins having a head at one end of said pin;

and wherein each of said platforms has front and rear end plates projecting radially inwardly towards said disc axis at the upstream and downstream ends respectively of said platform, and said front and rear end plates of each platform are provided with apertures for the passage of two adjacent pins belonging to said fixing means of the neighboring blades; and wherein said annular flanges have cut-outs between said roots of adjacent blades.

5. An axial flow turbomachine rotor comprising:

a disc having an axis, a circumferentially extending periphery, and a plurality of annular flanges extending outward from said periphery to define a plurality of annular grooves between said flanges, said flanges including front and rear annular flanges respectively positioned upstream and downstream with respect to the direction of fluid flow through said rotor;

a plurality of blades mounted on the periphery of said disc, said blades being arranged evenly around said periphery and extending radially outward therefrom, each of said blades having a root at its radially inner end, said root being notched so as to define heels which are received by respective ones of said annular grooves;

fixing means securing said blades to said disc; and a plurality of separate platforms fixed to said disc so that each platform is disposed between two adjacent blades to delimit the disc side of the fluid flow path through said rotor;

wherein said fixing means comprises, for each of said blades:

a pair of substantially parallel pins equidistant from the periphery of said disc, and corresponding bores passing right through said annular flanges of said disc and said heels of the blade, said pins extending through said bores at least between said front and rear annular flanges, and each of said pins having a head at one end of said pin;

and wherein each of said platforms has front and rear end plates projecting radially inwardly towards said disc axis at the upstream and downstream ends respectively of said platform, and said front and rear end plates of each platform are provided with apertures for the passage of two adjacent pins belonging to said fixing means of the neighboring blades; and wherein each heel of each of said blades includes bushes defining the portions of said bores extending through said heel, and each of said blades is made of a composite material including fibers which pass around said buses in said heels of said blade and extend therefrom towards the outer end of said blade.

6. An axial flow turbomachine rotor comprising:

a disc having an axis, a circumferentially extending periphery, and a plurality of annular flanges extending outward from said periphery to define a plurality of annular grooves between said flanges, said flanges including front and rear annular flanges respectively positioned upstream and downstream with respect to the direction of fluid flow through said rotor;

a plurality of blades mounted on the periphery of said disc, said blades being arranged evenly around said periphery and extending radially outward therefrom, each of said blades having a root at its radially inner end, said root being notched so as to define heels which are received by respective ones of said annular grooves;

fixing means securing said blades to said disc; and a plurality of separate platforms fixed to said disc so that each platform is disposed between two adjacent blades to delimit the disc side of the fluid flow path through said rotor;

wherein said fixing means comprises, for each of said blades:

a pair of substantially parallel pins equidistant from the periphery of said disc, and corresponding bores passing right through said annular flanges of said disc and said heels of the blade, said pins extending through said bores at least between said front and rear annular flanges, and each of said pins having a head at one end of said pin;

and wherein each of said platforms has front and rear end plates projecting radially inwardly towards said disc axis at the upstream and downstream ends respectively of said platform, and said front and rear end plates of each platform are provided with apertures for the passage of two adjacent pins belonging to said fixing means of the neighboring blades; and wherein said rear end plate of each platform is disposed between the downstream faces of said roots of the two adjacent blades and the upstream face of said rear annular flange.

7. An axial flow turbomachine rotor comprising:

a disc having an axis, a circumferentially extending periphery, and a plurality of annular flanges extending outward from said periphery to define a plurality of annular grooves between said flanges, said flanges including front and rear annular flanges respectively positioned upstream and downstream with respect to the direction of fluid flow through said rotor;

a plurality of blades mounted on the periphery of said disc, said blades being arranged evenly around said periphery and extending radially outward therefrom, each of said blades having a root at its radially inner end, said root being notched so as to define heels which are received by respective ones of said annular grooves;

fixing means securing said blades to said disc; and a plurality of separate platforms fixed to said disc so that each platform is disposed between two adjacent blades to delimit the disc side of the fluid flow path through said rotor;

wherein said fixing means comprises, for each of said blades:

a pair of substantially parallel pins equidistant from the periphery of said disc, and corresponding bores passing right through said annular flanges of said disc and said heels of the blade, said pins extending through said bores at least between said front and rear annular flanges, and each of said pins having a head at one end of said pin;

and wherein each of said platforms has front and rear end plates projecting radially inwardly towards said disc axis at the upstream and downstream ends respectively of said platform, and said front and rear end plates of each platform are provided with apertures for the passage of two adjacent pins belonging to said fixing means of the neighboring blades; and wherein said front end plate of each platform is disposed against the upstream face of said front annular flange and has two substantially parallel slots opening in the radially inner edge of said plate to form said apertures for the passage of said pins, said radially inner edge of said front end plate having a lip extending forwards and forming a lock with said heads of said pins.

8. A rotor according to claim 7, wherein the head of each pin has a lateral extension portion projecting towards the other of said two pins passing through the same platform front plate as each other, said extension portion having a cut-out which accommodates the extension portion of the head of said other pin whereby said extension portions are superimposed in line with the central area of said platform front plate.

9. A rotor according to claim 8, wherein said superimposed extension portions and said platform front plate are provided with aligned holes and said front plate has a nut secured on the downstream face of said front plate to receive a fixing screw passing through said aligned holes to secure said two pins and said platform together.

* * * * *